US011222539B2

(12) United States Patent
Yang

(10) Patent No.: US 11,222,539 B2
(45) Date of Patent: Jan. 11, 2022

(54) METHOD FOR EARLY WARNING OF VEHICLE COLLISION, ON-BOARD TERMINAL AND SERVER

(71) Applicants: Hefei Xinsheng Optoelectronics Technology Co., Ltd., Anhui (CN); BOE Technology Group Co., Ltd., Beijing (CN)

(72) Inventor: Lin Yang, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/836,218

(22) Filed: Mar. 31, 2020

(65) Prior Publication Data

US 2021/0065550 A1 Mar. 4, 2021

(30) Foreign Application Priority Data

Aug. 30, 2019 (CN) ..... 201910816239.9

(51) Int. Cl.
*G08G 1/16* (2006.01)

(52) U.S. Cl.
CPC ..... *G08G 1/16* (2013.01)

(58) Field of Classification Search
None
See application file for complete search history.

(56) References Cited

U.S. PATENT DOCUMENTS

2017/0046958 A1 2/2017 Naka et al.
2019/0069052 A1* 2/2019 Al-Stouhi ..... H04Q 9/00

FOREIGN PATENT DOCUMENTS

CN 104269070 A 1/2015
CN 104408970 A * 3/2015
CN 104408970 A 3/2015
CN 105303886 A 2/2016
CN 105761546 A 7/2016
(Continued)

OTHER PUBLICATIONS

May 9, 2020—(CN) First Office Action Appn 201910816239.9 with English Translation.
(Continued)

*Primary Examiner* — Adolf Dsouza
(74) *Attorney, Agent, or Firm* — Banner & Witcoff, Ltd.

(57) ABSTRACT

The present application discloses a method for early warning of vehicle collision, an on-board terminal and a server. The method includes: acquiring distance-sensing data detected by sensors configured in the first vehicle as first distance-sensing data; determining whether there is an obstacle within an early warning range of the first vehicle based on the first distance-sensing data; acquiring distance-sensing data transmitted by on-board terminals of other vehicles within a communication range of the first vehicle as second distance-sensing data when it is determined that there is an obstacle in the early warning range of the first vehicle; determining whether the obstacle is a vehicle based on a matching result of the first distance-sensing data and the second distance-sensing data; outputting a first early warning information when it is determined that the obstacle is a vehicle.

13 Claims, 9 Drawing Sheets

(56) References Cited

FOREIGN PATENT DOCUMENTS

| | | | |
|---|---|---|---|
| CN | 106463059 | A | 2/2017 |
| CN | 106781700 | A | 5/2017 |
| CN | 107591025 | A | 1/2018 |
| CN | 109426259 | A | 3/2019 |
| JP | S5327972 | A | 3/1978 |

OTHER PUBLICATIONS

Nov. 23, 2020—(CN) Second Office Action Appn 201910816239.9 with English Translation.

* cited by examiner

METHOD FOR EARLY WARNING OF VEHICLE COLLISION, ON-BOARD TERMINAL AND SERVER

CROSS REFERENCE TO RELATED APPLICATION

The present application claims priority to and the benefit of Chinese Patent Application No. 201910816239.9 filed on Aug. 30, 2019, the disclosure of which is incorporated herein by reference in its entirety as part of the present application.

TECHNICAL FIELD

The present disclosure relates to a field of assisted driving technique, and in particular to a method for early warning of vehicle collision, an on-board terminal, and a server.

BACKGROUND

At present, more and more people choose to travel by vehicles which leads to more vehicles on the road. Therefore, traffic accidents such as vehicle collisions are becoming more frequent, which brings a greater threat to the safety of people. Existing early warning schemes for vehicle danger are difficult to meet requirements of assisted driving, and have defects such as low accuracy, high false-positive rate, poor real-time performance and so on.

SUMMARY OF THE DISCLOSURE

The present disclosure provides a method for early warning of vehicle collision applied to a first on-board terminal, wherein the first on-board terminal is configured in a first vehicle. The method comprises: acquiring distance-sensing data detected by sensors configured in the first vehicle as first distance-sensing data; determining whether there is an obstacle within an early warning range of the first vehicle based on the first distance-sensing data; acquiring distance-sensing data transmitted by on-board terminals of other vehicles within a communication range of the first vehicle as second distance-sensing data when it is determined that there is an obstacle in the early warning range of the first vehicle; determining whether the obstacle is a vehicle based on a matching result of the first distance-sensing data and the second distance-sensing data; and outputting a first early warning information when it is determined that the obstacle is a vehicle.

According to some embodiments of the present disclosure, the method further comprises: acquiring speed information and orientation information of the first vehicle; determining the early warning range of the first vehicle according to the speed information and the orientation information; or determining the early warning range of the first vehicle according to the speed information, the orientation information, and vehicle type information of the first vehicle, wherein the determining whether there is an obstacle within an early warning range of the first vehicle based on the first distance-sensing data comprises: determining a distance between the obstacle and the first vehicle based on the first distance-sensing data; determining whether the obstacle is within the early warning range based on the distance between the obstacle and the first vehicle.

According to some embodiments of the present disclosure, the outputting a first early warning information comprises: determining an early warning level according to the distance between the obstacle and the first vehicle; outputting a first early warning information which includes the early warning level; or determining a safe speed of the first vehicle according to the distance between the obstacle and the first vehicle and a reaction time; outputting a first early warning information which includes the safe speed.

According to some embodiments of the present disclosure, the acquiring distance-sensing data transmitted by on-board terminals of other vehicles within a communication range of the first vehicle as second distance-sensing data comprises: establishing a wireless connection with a second on-board terminal, wherein the second on-board terminal is configured in a second vehicle, and the second vehicle is other vehicle within the communication range of the first vehicle; receiving distance-sensing data detected by sensors configured in the second vehicle and transmitted by the second on-board terminal as the second distance-sensing data.

According to some embodiments of the present disclosure, wherein a plurality of first sensors are respectively disposed at a plurality of preset positions of the first vehicle; a plurality of second sensors are respectively disposed at a plurality of preset positions of the second vehicle, the acquiring distance-sensing data detected by sensors configured in the first vehicle as first distance-sensing data comprises: receiving a first sensing message transmitted by each of the plurality of first sensors, wherein the first sensing message includes an identifier of the first sensor and its corresponding first distance-sensing data, the receiving distance-sensing data detected by sensors configured in the second vehicle and transmitted by the second on-board terminal as the second distance-sensing data comprises: receiving a second sensing message transmitted by the second on-board terminal, wherein the second sensing message includes an identifier of each of the plurality of second sensors and its corresponding second distance-sensing data, wherein the determining whether the obstacle is a vehicle comprises: determining whether there are matched first distance-sensing data and second distance-sensing data; if so, determining that the obstacle is a vehicle. The method further comprises: determining, for first distance-sensing data and second distance-sensing data that are successfully matched, location information of a vehicle corresponding to the second distance-sensing data according to an identifier of a first sensor corresponding to the first distance-sensing data and an identifier of a second sensor corresponding to the second distance-sensing data, the outputting a first early warning information comprises: outputting a first early warning information which includes the location information.

According to some embodiments of the present disclosure, the establishing a wireless connection with a second on-board terminal comprises: establishing a wireless connection with the second on-board terminal configured in the second vehicle through wireless transceivers configured in the first vehicle and the second vehicle; or establishing a Bluetooth connection with the second on-board terminal.

According to some embodiments of the present disclosure, the establishing a wireless connection with a second on-board terminal comprises: searching, by means of broadcasting, for an on-board terminal of other vehicle within the communication range of the first on-board terminal as the second on-board terminal; if an on-board terminal is found as the second on-board terminal, establishing a wireless connection with the second on-board terminal; if an on-board terminal is not found, stopping the broadcasting, and establishing a wireless connection with a second on-board terminal that transmits a connection request when receiving the connection request of the second on-board terminal.

According to some embodiments of the present disclosure, the method further comprises: acquiring positioning information of the first vehicle; transmitting the positioning information and the early warning range of the first vehicle to a server, so that the server determines whether there are mutually intersected early warning ranges based on received positioning information and early warning ranges transmitted by on-board terminals, and if so, transmits a second early warning information to an on-board terminal within the mutually intersected early warning ranges.

The present disclosure further provides a method for early earning of vehicle collision applied to a server. The method comprises: acquiring vehicle data transmitted by a plurality of on-board terminals, the vehicle data including positioning information of vehicles, driving speed of vehicles, and orientation information of vehicles; determining an early warning range of a vehicle to which each of the plurality of on-board terminals belongs based on the vehicle data; determining whether there are mutually intersected early warning ranges in early warning ranges of the plurality of on-board terminals; transmitting a third early warning information to an on-board terminal within the mutually intersected early warning ranges when there are mutually intersected early warning ranges.

According to some embodiments of the present disclosure, the method further comprises: predicting, for the on-board terminal within the mutually intersected early warning ranges, a movement trajectory of a vehicle to which the on-board terminal belongs based on vehicle data transmitted by the on-board terminal, the movement trajectory including time information and position information of a plurality of trajectory points; determining trajectory points with both same time information and same position information as matched trajectory points by matching the movement trajectory.

According to some embodiments of the present disclosure, the transmitting a third early warning information to an on-board terminal within the mutually intersected early warning ranges comprises: transmitting the third early warning information to an on-board terminal corresponding to the matched trajectory points, wherein the third early warning information includes time information and position information of the matched trajectory points.

The present disclosure further provides an on-board terminal comprising a memory, a processor, and a computer program stored on the memory and executable on the processor, the processor implementing the method for early warning of vehicle collision applied to a first on-board terminal when the processor executes the program.

The present disclosure further provides a server comprising a memory, a processor, and a computer program stored on the memory and executable on the processor, the processor implementing the method for early warning of vehicle collision applied to a server, when the processor executes the program.

The present disclosure further provides an on-board terminal comprising: a first processor, a plurality of second processors, and a wireless transceiver, wherein each second processor is connected to a sensor, and wherein the wireless transceiver is configured to communicate with other on-board terminals; each second processor is configured to transmit first distance-sensing data detected by a sensor connected to itself to the first processor; the first processor is configured to determine whether there is an obstacle within an early warning range of the on-board terminal based on the received first distance-sensing data; acquire, through the wireless transceiver, distance-sensing data transmitted by on-board terminals of other vehicles as second distance-sensing data when it is determined that there is an obstacle; determine whether the obstacle is a vehicle based on a matching result of the first distance-sensing data and the second distance-sensing data; output a first early warning information when it is determined that the obstacle is a vehicle.

According to some embodiments of the present disclosure, the on-board terminal further comprises a positioner and a speed detector; the positioner being configured to obtain orientation information of a vehicle to which it belongs, and transmit the orientation information to the first processor; the speed detector being configured to collect speed information of a vehicle to which it belongs, and transmit the speed information to the first processor; the first processor being further configured to determine an early warning range of a vehicle to which it belongs according to the speed information and the orientation information; or determine the early warning range of the vehicle to which it belongs according to the speed information, the orientation information, and vehicle type information of the vehicle to which it belongs.

BRIEF DESCRIPTION OF THE DRAWINGS

In order to illustrate technical solutions of embodiments of the present disclosure more clearly, accompanying drawings used in description of the embodiments or the prior art will be briefly introduced below. Obviously, the accompanying drawings in the following description are merely some of the embodiments of the present disclosure. Those skilled in the art may further obtain other accompanying drawings according to these accompanying drawings without creative effort.

DESCRIPTION OF THE EMBODIMENTS

In order to make objectives, technical solutions, and advantages of the present disclosure clearer, the present disclosure will be further described in detail below in conjunction with specific embodiments and with reference to the accompanying drawings.

It should be noted that all expressions using "first" and "second" in the embodiments of the present disclosure are used to distinguish two different entities or different parameters with the same name. It can be seen that "first" and "second" are only for convenience of expression, and should not be construed as a limitation on the embodiments of the present disclosure, which will not be explained one by one in subsequent embodiments.

In order to realize assisted driving to early warn danger of vehicles accurately, the present disclosure provides a method for early warning of vehicle collision applied to an on-board terminal, a method for early warning of vehicle collision applied to a server, an on-board terminal and a server to perform early warning of vehicle collision, thereby achieving functions of assisted driving.

The method for early warning of vehicle collision applied to an on-board terminal will be described below in detail firstly. In order to distinguish descriptions, an execution body is referred to as a first on-board terminal, and a vehicle to which the first on-board terminal belongs is referred to as a first vehicle. In the method for early warning of vehicle collision applied to an on-board terminal provided by the present disclosure, if there is an obstacle in an early warning range of the vehicle, distance-sensing data of the vehicle itself is matched with distance-sensing data of other vehicles. Whether the obstacle is a vehicle or not is determined based on a matching result, and a first early warning information is output when it is determined that the obstacle is a vehicle. It can be seen that in the present disclosure, early warning is performed only when the obstacle is a vehicle, which reduces a false-positive rate of early warning.

Figure 1:
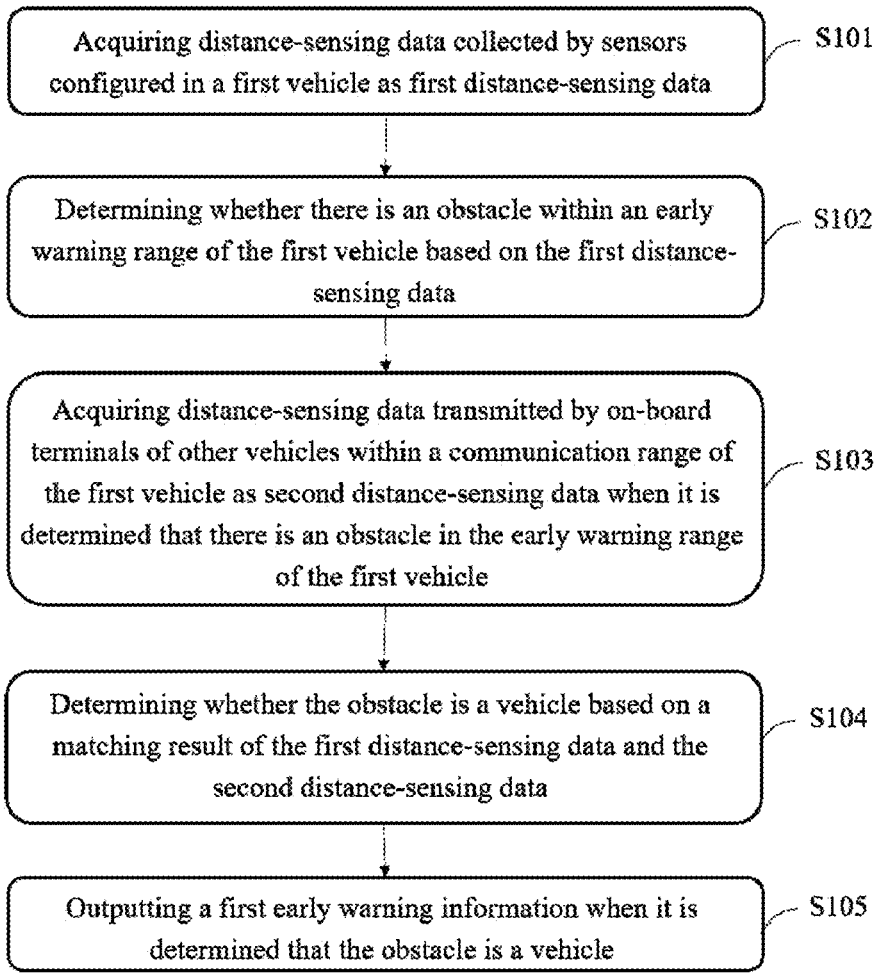
FIG. 1 is a schematic flowchart of a method for early warning of vehicle collision applied to an on-board terminal provided by the embodiments of the present disclosure.

FIG. 1 is a schematic flowchart of a method for early warning of vehicle collision applied to an on-board terminal provided by the embodiments of the present disclosure.

As shown in FIG. 1, in step S101, distance-sensing data detected by sensors configured in a first vehicle is acquired as first distance-sensing data.

For example, one or more sensors may be configured in a vehicle, and the specific number is not limited. If a plurality of sensors are configured in the vehicle, distance-sensing data in a plurality of directions may be detected, and more accurate early warning of vehicle collision may be performed based on the distance-sensing data in the plurality of directions.

Figure 2:
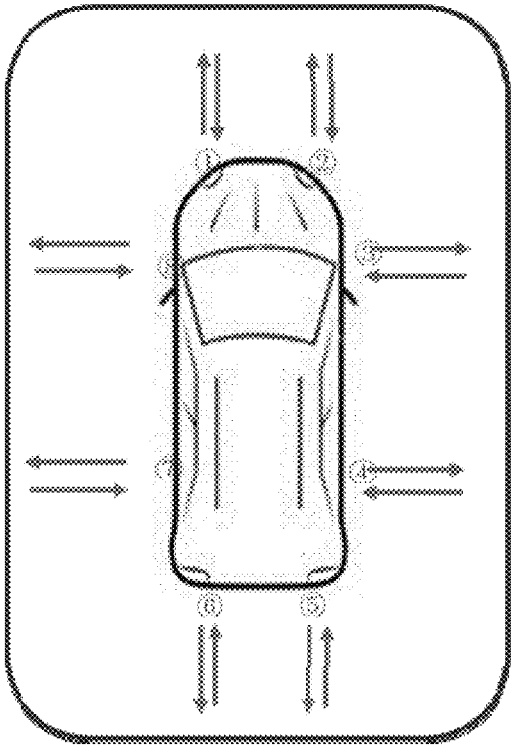
FIG. 2 is a schematic diagram of configuration positions of sensors provided by the embodiments of the present disclosure.

FIG. 2 is a schematic diagram of configuration positions of sensors provided by the embodiments of the present disclosure. Referring to FIG. 2, a total of 8 sensors may be arranged at the front, back, left, and right of the vehicle, and these sensors may monitor whether there is an obstacle in 8 directions around the vehicle. If there is an obstacle, distance-sensing data of the obstacle and the vehicle may be further detected. In order to distinguish descriptions, the distance-sensing data detected by the sensors configured in the first vehicle is referred to as the first distance-sensing data.

Next, in step S102, whether there is an obstacle in an early warning range of the first vehicle is determined based on the first distance-sensing data. The early warning range represents a safe distance for the vehicle to travel. If the obstacle is outside the early warning range, it indicates that a risk of collision with the vehicle is small, and the vehicle can drive safely. If the obstacle is within the early warning range, it indicates that a risk of collision with the vehicle is large, and the driver should be alert or make corresponding driving decisions to avoid a collision.

For example, S102 may include: determining a distance between the obstacle and the first vehicle based on the first distance-sensing data; and determining whether the obstacle is within the early warning range based on the distance between the obstacle and the first vehicle.

As an example, the early warning range may be a fixed range. For example, taking the vehicle as a center point, a range within a distance of 10 meters from the vehicle may be set as the early warning range, in which the distance may be set according to actual conditions, such as 5 meters, 15 meters and so on, and the specific value is not limited. The early warning range may be a circular range, a rectangular range, an elliptical range, etc., and the specific shape of the early warning range is not limited.

As another example, the early warning range may be a dynamic range, for example, speed information and orientation information of the first vehicle may be acquired; in one embodiment, the early warning range of the first vehicle may be determined according to the speed information and the orientation information.

According to some embodiments of the present disclosure, the vehicle may be configured with MPU6000 (a 6-axis motion processing component), and the MPU6000 may collect acceleration data and direction data of the vehicle, so that the speed information and the orientation information of the vehicle may be obtained. Alternatively, other acquisition detectors may be configured in the vehicle to detect the speed information and the orientation information of the vehicle, which are not specifically limited.

Figure 3:
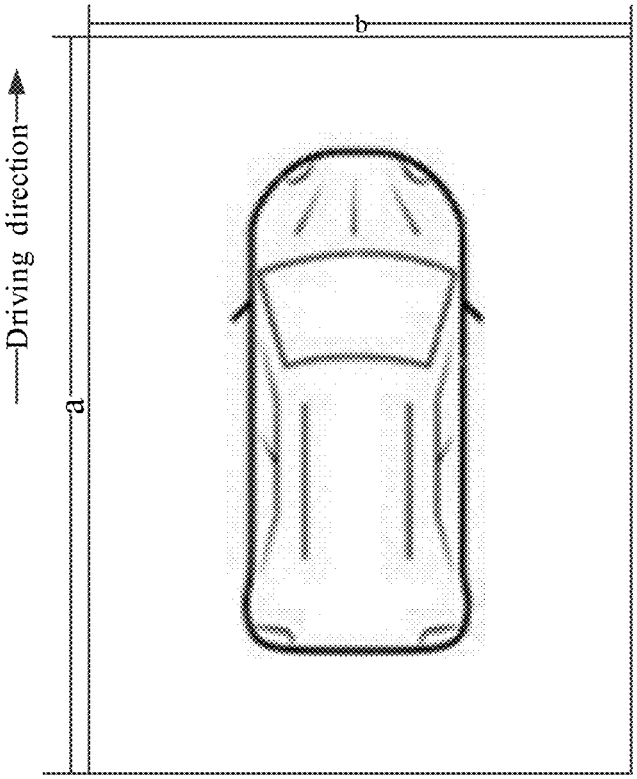
FIG. 3 is a schematic diagram of an early warning range provided by the embodiments of the present disclosure.

FIG. 3 is a schematic diagram of an early warning range provided by the embodiments of the present disclosure, where the early warning range is a rectangle. Referring to FIG. 3, the size of the rectangle is dynamically variable, the length of the rectangle (that is, the value of a) is proportional to the speed of the vehicle in a driving direction of the vehicle, and the width of the rectangle (that is, the value of b) may be a fixed value, which may be determined based on boundaries of the vehicle. If the vehicle turns, a direction of the vehicle may be re-determined based on direction data detected by the MPU6000, and then the early warning range of the vehicle is re-determined.

According to other embodiments of the present disclosure, the early warning range of the first vehicle may be determined according to the speed information, the orientation information, and vehicle type information of the first vehicle.

Quality and inertia of vehicles are different for different vehicle types. In this implementation, the vehicle type information is also used as a factor to be considered for a safe distance (i.e., the early warning range) of the vehicle. For example, the vehicle type information may be obtained by pre-registration. In a process of vehicle driving, a dynamic early warning range is formed by combining real-time speed information, the orientation information, and the pre-obtained vehicle type information of the vehicle. In the foregoing implementation, the early warning range of the vehicle is dynamically determined according to actual conditions of the vehicle, and the determined early warning range is more reasonable.

Next, as shown in FIG. 1, in step S103, when it is determined that there is an obstacle in the early warning range of the first vehicle, distance-sensing data transmitted by on-board terminals of other vehicles within a communication range of the first vehicle is obtained as second distance-sensing data. The other vehicles may be one vehicle or a plurality of vehicles.

In this implementation, step S103 may include: establishing a wireless connection with a second on-board terminal; where the second on-board terminal is configured in a second vehicle, and the second vehicle is other vehicle within the communication range of the first vehicle; receiving distance-sensing data detected by sensors configured in the second vehicle and transmitted by the second on-board terminal as the second distance-sensing data.

In order to distinguish descriptions, other vehicles within the communication range of the first vehicle will be referred to as the second vehicle, on-board terminals configured in the second vehicle will be referred to as the second on-board terminal, and distance-sensing data detected by sensors configured in the second vehicle will be referred to as the second distance-sensing data.

According to some embodiments of the present disclosure, the first vehicle may continuously establish wireless connection with on-board terminals of other vehicles within its communication range, and acquire the second distance-sensing data when it is determined that there is an obstacle within the early warning range of the first vehicle.

According to other embodiments of the present disclosure, the first vehicle may establish wireless connections with on-board terminals of other vehicles within its communication range only when it is determined that there is an obstacle within its own early warning range. In this way, communication resources may be saved compared with continuous connections.

According to some embodiments of the present disclosure, the establishing a wireless connection with a second on-board terminal may comprise: establishing a wireless connection with the second on-board terminal configured in the second vehicle through wireless transceivers configured in the first vehicle and the second vehicle; or, establishing a Bluetooth connection with the second on-board terminal.

That is, in one case, data may be transmitted between on-board terminals through Bluetooth modules in vehicles, which eliminates the need to configure other communication devices and thus saves costs. In another case, wireless transceivers may be configured in vehicles, and data transmission between on-board terminals may be realized through the wireless transceivers. In this way, in a first aspect, independent communication channels are formed between the wireless transceivers, which are less affected by other signals; in a second aspect, the wireless transceivers do not need to be paired and communicate directly based on an agreed protocol.

According to other embodiments of the present disclosure, the establishing a wireless connection with a second on-board terminal may comprise: searching, by means of broadcasting, for an on-board terminal of other vehicle within the communication range of the first on-board terminal as the second on-board terminal; if an on-board terminal is found as the second on-board terminal, establishing a wireless connection with the second on-board terminal; if an on-board terminal is not found, stopping the broadcasting, and establishing a wireless connection with a second on-board terminal that transmits a connection request when receiving the connection request of the second on-board terminal.

In this implementation, the on-board terminal may have two modes, an active search mode and a passive discovery mode. In some case, if both on-board terminals enable the active search mode, it is possible that they cannot search each other, and in this case, one on-board terminal may be switched to the passive discovery mode, which can reduce a situation that both on-board terminals search actively but cannot discovery each other.

As described above, data transmission between on-board terminals may be achieved through wireless transceivers configured in vehicles. The active search mode and the passive discovery mode may be configured in the wireless transceivers. If the active search mode is enabled by a wireless transceiver, a small regional hotspot may be formed; and if the passive discovery mode is enabled by the wireless transceiver, it waits for other wireless transceivers to establish a connection with it.

Next, as shown in FIG. 1, in step S104, whether the obstacle is a vehicle is determined based on a matching result of the first distance-sensing data and the second distance-sensing data. And, in step S105, if it is determined that the obstacle is a vehicle, a first early warning information is output.

In order to distinguish it from early warning information described below, herein, the early warning information output in S105 is referred to as the first early warning information. For example, the form of the early warning information may be: output-text prompt information, voice prompt information, light flashing, buzzing sound, etc., and the specific form is not limited. It should be noted that "first", "second" and similar words used in this disclosure do not indicate any order, quantity, or importance, but are only used to distinguish different components, such as the first early warning information, and a second early warning information, a third early warning information, etc. described below.

According to some embodiments of the present disclosure, the outputting a first early warning information may comprise: determining an early warning level according to a distance between the obstacle and the first vehicle; outputting a first early warning information which includes the early warning level.

In this implementation, a correspondence relationship between the distance of the obstacle and the early warning level may be set in advance, and the smaller the distance, the higher the level. Based on the distance-sensing data acquired in S101, the distance between the vehicle and the obstacle may be determined, and then the early warning level may be determined based on the corresponding relationship, where the early warning level may prompt the driver to a safety risk situation. In this implementation, the early warning level is carried in the output early warning information, which is richer in content.

For example, assuming that the early warning manner is a beep, the higher the early warning level, the louder the beep. Alternatively, different types of beeps may be used for different early warning levels. Assuming that the early warning manner is light flashing, the higher the early warning level, the greater the light intensity. Alternatively, different types of light flashing may be used for different early warning levels. The specific early warning manner is not limited.

According to other embodiments of the present disclosure, the outputting a first early warning information may comprise: determining a safe speed of the first vehicle according to the distance between the obstacle and the first vehicle and a reaction time; outputting a first early warning information which includes the safe speed.

The reaction time may be understood as a time period required for a driver to take a brake or other measures to avoid a collision. Based on the distance-sensing data acquired in S101, the distance between the vehicle and the obstacle may be determined. In one case, a quotient of the distance and the reaction time may be calculated as the safe speed of the first vehicle. In this implementation, the safe speed is carried in the output early warning information to prompt the user to drive within the safe speed range.

In one implementation, a plurality of first sensors are respectively disposed at a plurality of preset positions of the first vehicle, and a plurality of second sensors are respectively disposed at a plurality of preset positions of the second vehicle, for example, as shown in FIG. 2. In this implementation, the acquiring distance-sensing data detected by sensors configured in the first vehicle may comprise: receiving a first sensing message transmitted by each of the plurality of first sensors, the first sensing message including an identifier of the first sensor and its corresponding first distance-sensing data. For example, in the case that eight first sensors are disposed in the first vehicle in accordance with the positions shown in FIG. 2, first sensing messages respectively transmitted by the eight first sensors will be received, and each sensing message includes an identifier of a first sensor and first distance-sensing data.

The receiving distance-sensing data detected by sensors configured in the second vehicle and transmitted by the second on-board terminal may comprise: receiving a second sensing message transmitted by the second on-board terminal, the second sensing message including an identifier of each of the plurality of second sensors and its corresponding second distance-sensing data.

The determining whether the obstacle is a vehicle may comprise: determining whether there are matched first distance-sensing data and second distance-sensing data; if so, determining that the obstacle is a vehicle. With respect to the matching between the first distance-sensing data and the second distance-sensing data, assuming that the first distance-sensing data indicate that there is an obstacle at a distance of 5 m from the first vehicle, and the second distance-sensing data indicates that there is an obstacle at a distance of 5 m from the second vehicle, then it indicates that the first vehicle and the second vehicle are obstacles to each other, in which case it indicates that matching results are consistent, that is, the two vehicles are likely to collide, and a first early warning information is output.

According to the embodiments of the present disclosure, the method for early warning of vehicle collision applied to the first on-board terminal further comprises: determining, for first distance-sensing data and second distance-sensing data that are successfully matched, location information of a vehicle corresponding to the second distance-sensing data according to an identifier of a first sensor corresponding to the first distance-sensing data and an identifier of a second sensor corresponding to the second distance-sensing data. The location information represents a location of another vehicle being an obstacle relative to the current first vehicle.

The outputting a first early warning information further comprises: outputting a first early warning information which includes the location information.

Figure 4:
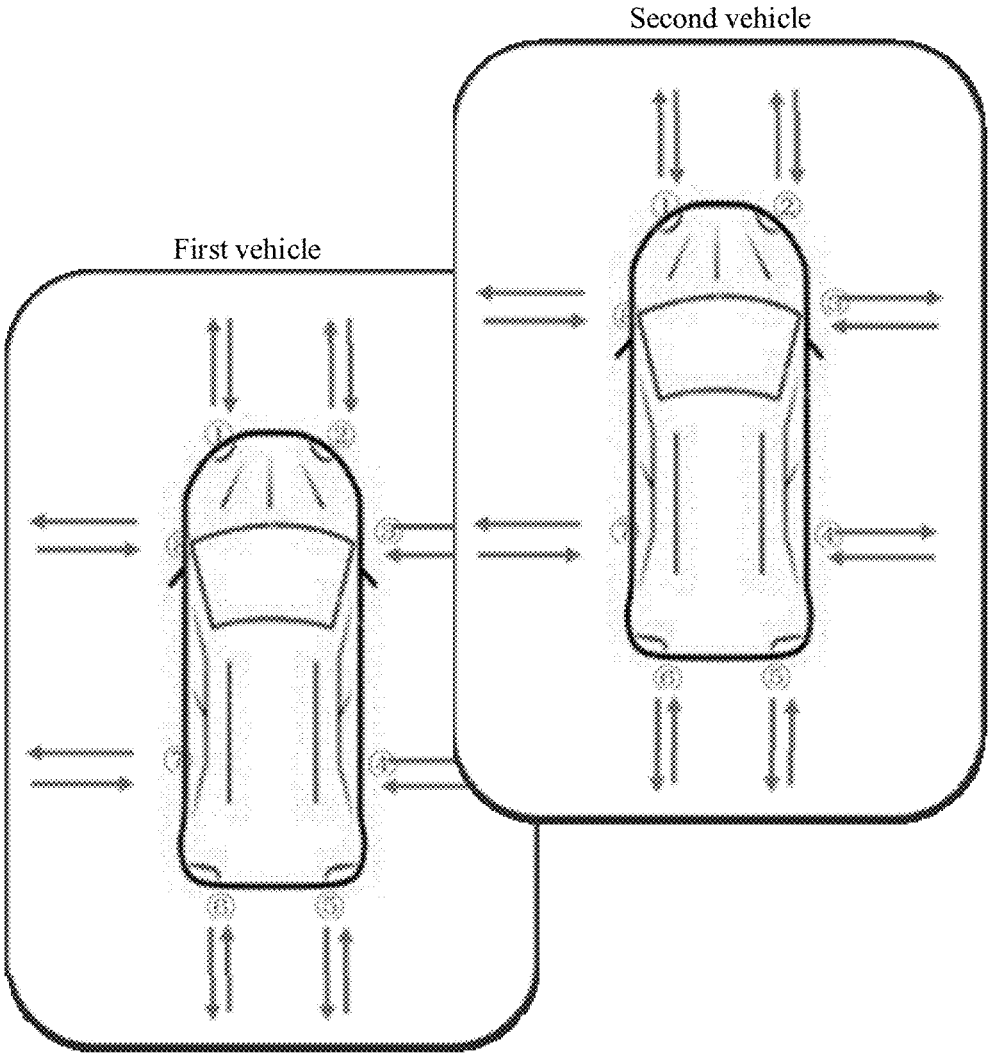
FIG. 4 is a schematic diagram of vehicle location provided by the embodiments of the present disclosure.

Referring to FIG. 2, sensors are configured at a plurality of preset positions of the vehicle, and distance-sensing data detected by different sensors may be distinguished by using identifiers of the sensors. It is assumed that the identifiers of the sensor are ①-⑧ in FIG. 2. For example, assuming that a distance between the first vehicle and the obstacle is determined as 5 m based on first distance-sensing data detected by the sensor ③ in the first vehicle, and a distance between the second vehicle and the obstacle is determined as 5 m based on second distance-sensing data detected by the sensor ⑦ in the second vehicle, then the position of the sensor ③ in the first vehicle may be considered to be 5 m away from the position of the sensor ⑦ in the second vehicle. FIG. 4 is a schematic diagram of vehicle location provided by the embodiments of the present disclosure. As shown in FIG. 4, the second vehicle is located in front right of the first vehicle. Thus, it may be realized to determine location information of a vehicle corresponding to the second distance-sensing data according to an identifier of a first sensor corresponding to the first distance-sensing data and an identifier of a second sensor corresponding to the second distance-sensing data.

As an example, the early warning information output in S105 may include location information. For example, the output early warning information may be "Please note that a collision with a vehicle in front right may occur", or other similar information, so as to prompt the user more accurately to avoid vehicles in front right and thus achieve a more accurate early warning.

Alternatively, the output early warning information may further include driving recommendations for the driver, for example, "Please note that a collision with a vehicle in front right may occur. Please turn left", etc., or other similar information.

By applying the embodiments shown in the present disclosure, if an obstacle exists in the early warning range of the vehicle, the distance-sensing data of the vehicle itself is matched with distance-sensing data of other vehicles, and whether the obstacle is a vehicle is determined based on a matching result; if so, a first early warning information is output. For example, the obstacle may be a fixed obstacle such as a roadside stone, and for this obstacle, the driver may keep an original driving direction and driving speed to pass safely without a possibility of collision. In the method of the present disclosure, early warning of collision to this obstacle should not be performed to avoid unnecessary early warning of danger.

According to the embodiments of the present disclosure, the method for early warning of vehicle collision applied to the first on-board terminal further comprises: acquiring positioning information of the first vehicle; transmitting the positioning information and the early warning range of the first vehicle to a server, so that the server determines whether there are mutually intersected early warning ranges based on received positioning information and early warning ranges transmitted by on-board terminals, and if so, transmits a second early warning information to an on-board terminal within the mutually intersected early warning ranges. In order to distinguish it from other early warning information, the early warning information transmitted by the server in this implementation is referred to as the second early warning information.

For example, a GPS (Global Positioning System) may be installed in a vehicle to obtain the vehicle's positioning information through the GPS. As described above, the early warning range may be a fixed range or a dynamic range.

In one case, the on-board terminal may transmit the positioning information and the early warning range to the server in a timing transmission manner or in an interrupted response transmission manner via the 3G (the 3rd Generation) or 4G (the 4th Generation) network.

In this implementation, respective on-board terminals transmit positioning information and early warning ranges of vehicles to which they belong to the server, and the server performs overall early warning, which provides a more timely early warning from a global perspective compared with a single on-board terminal's early warning scheme.

Figure 5:
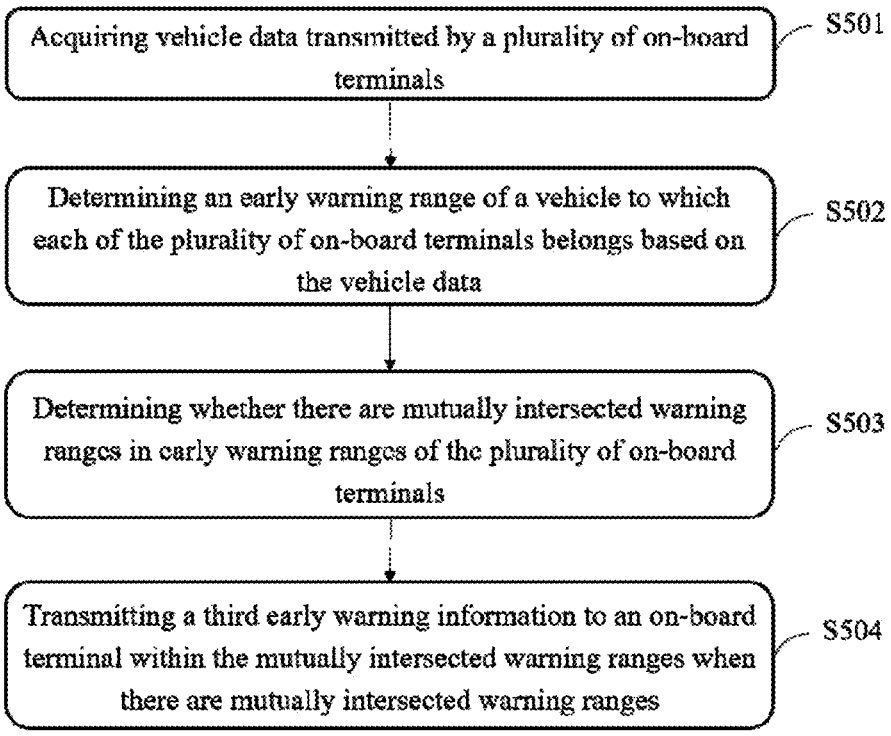
FIG. 5 is a schematic flowchart of a method for early warning of vehicle collision applied to a server provided by the embodiments of the present disclosure.

FIG. 5 is a schematic flowchart of a method for early warning of vehicle collision applied to a server according to the embodiments of the present disclosure. As shown in FIG. 5, in step S501, vehicle data transmitted by a plurality of on-board terminals is acquired, the vehicle data including positioning information of vehicles, driving speed of vehicles, and orientation information of vehicles.

For example, GPSs (Global Positioning Systems) may be installed in vehicles to obtain the vehicles' positioning information through the GPSs. The MPU6000s may also be configured in the vehicles, and acceleration data and direction data of the vehicles may be detected by the MPU6000s. In this way, the driving speed of the vehicles and the orientation information of the vehicles may be obtained. Alternatively, other acquisition detectors may be configured in the vehicles to detect the vehicles' driving speed and orientation information, which is not specifically limited. Respective on-board terminals transmit vehicle data of vehicles to which they belong to the server.

In one case, an on-board terminal may transmit vehicle data to the server in a timing transmission manner or in an interrupted response transmission manner via a 3G (the 3rd Generation) or 4G (the 4th Generation) network.

In step S502, an early warning range of a vehicle to which each of the plurality of on-board terminals belongs is determined based on the vehicle data.

In one case, the early warning range may be a fixed range. For example, a range within a distance of 10 meters from the vehicle may be set as the early warning range, in which the distance may be set according to actual conditions, such as 5 meters and 15 meters, and the specific value is not limited. The early warning range may be a circular range, a rectangular range, an elliptical range, etc., and the specific shape of the early warning range is not limited.

In another case, the early warning range may be a dynamic range. For example, the early warning range of the vehicle may be determined according to the driving speed of the vehicle and the orientation information of the vehicle acquired in S501.

Assuming that the early warning range is rectangular, referring to FIG. 3, the size of the rectangle is dynamically variable, the length of the rectangle (that is, the value of a) is proportional to the speed of the vehicle in a driving direction of the vehicle, and the width of the rectangle (that is, the value of b) may be a fixed value, which may be determined based on boundaries of the vehicle. If the vehicle turns, a direction of the vehicle may be re-determined based on direction data collected by the MPU6000, and then the early warning range of the vehicle is re-determined.

For another example, the early warning range of the vehicle may be determined according to the driving speed of the vehicle and the orientation information of the vehicle acquired in S501, and vehicle type information of the vehicle.

Quality and inertia of vehicles are different for different vehicle types. In this implementation, vehicle type information is also used as a factor to be considered for a safe distance (i.e., the early warning range) of a vehicle. For example, the vehicle type information may be obtained by pre-registration. In a process of vehicle driving, a dynamic early warning range is formed by combining real-time speed information, the orientation information, and the pre-obtained vehicle type information of the vehicle.

In the foregoing implementation, the early warning range of the vehicle is dynamically determined according to actual conditions of the vehicle, and the determined early warning range is more reasonable.

Figure 6:
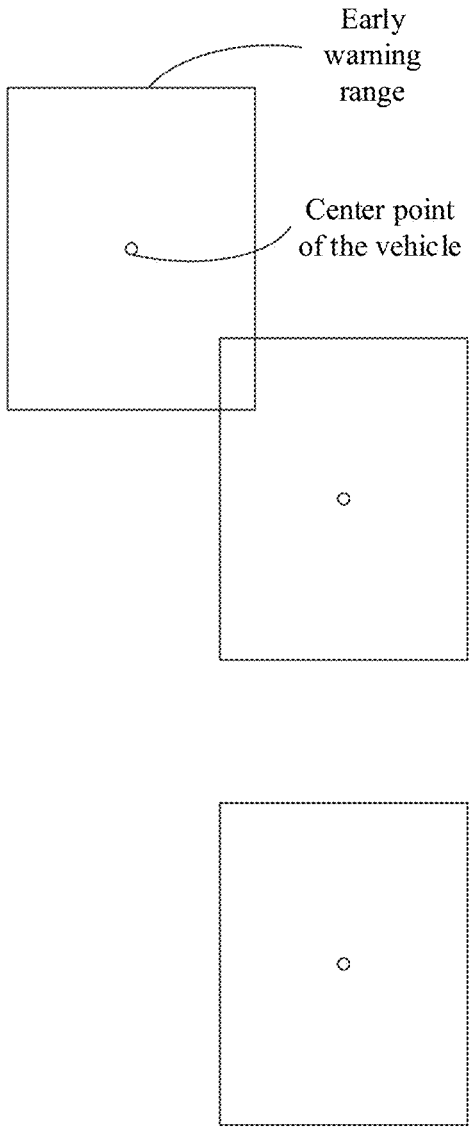
FIG. 6 is a schematic diagram of positioning an early warning range provided by the embodiments of the present disclosure.

For example, FIG. 6 is a schematic diagram of positioning an early warning range provided by the embodiments of the present disclosure. Referring to FIG. 6, the positioning information of the vehicle may be considered as a geographical location of the center point of the vehicle, and geographical location information of the early warning range may be determined according to the positioning information. Alternatively, it may be understood as determining the early warning range in an electronic map, and then whether there are mutually intersected early warning ranges is decided.

Next, as shown in FIG. 5, in step S503, whether there are mutually intersected early warning ranges in early warning ranges of the plurality of on-board terminals is determined. And, in step S504, in the case that there are mutually intersected early warning ranges, a third early warning information is transmitted to an on-board terminal within the mutually intersected early warning ranges.

In order to distinguish it from other early warning information, the early warning information in S503 is referred to as the third early warning information.

In one implementation, the server may: determine a distance between vehicles based on vehicle data, and determine an early warning level based on the distance between the vehicles; output a first early warning information which includes the early warning level.

In this implementation, a correspondence relationship between the distance between the vehicles and the early warning level may be set in advance, and the smaller the distance, the higher the level. The early warning level may prompt drivers to a safety risk situation. In this implementation, the early warning level is carried in the output early warning information, which is richer in content.

In one implementation, a safe speed of the vehicles may be determined according to the distance between the vehicles and a reaction time. The third early warning information includes the safe speed is output.

The reaction time may be understood as a time period required for a driver to take a brake or other measures to avoid a collision. In one case, a quotient of the distance between the vehicles and the reaction time may be calculated as the safe speed of the vehicles. In this implementation, the safe speed is carried in the output early warning information to prompt the user to drive within the safe speed range.

In one implementation, if it is determined that there are mutually intersected early warning ranges in the early warning ranges of the plurality of on-board terminals, for the on-board terminal within the mutually intersected early warning ranges, a movement trajectory of a vehicle to which the on-board terminal belongs may be further projected based on the vehicle data transmitted by the on-board terminal, the movement trajectory including time information and position information of a plurality of trajectory points; trajectory points with both same time information and same position information are determined as matched trajectory points by matching the movement trajectory; the transmitting a third early warning information to an on-board terminal within the mutually intersected early warning ranges comprises: transmitting the third early warning information to an on-board terminal corresponding to the matched trajectory points, wherein the third early warning information includes time information and position information of the matched trajectory points.

In this implementation, the server may predict a movement trajectory of a vehicle based on received vehicle data, and determine whether the vehicle is likely to collide based on the movement trajectory, and if so, further determine a time and a location of the collision (the time information and the position information of the matched trajectory points). In this way, a user may be more accurately prompted to avoid vehicles that may collide with, thereby realizing a more accurate early warning. By applying this implementation, the server may analyze and predict a collision risk of vehicles after a period of time in the future.

Furthermore, the server may generate driving recommendation information for the user according to the time information and/or the position information of the matched trajectory points, and the third early warning information may further include the driving recommendation information. For example, assuming that the position information of the matched trajectory points is front right, the driving recommendation information may be "Turn left", etc., which is no longer listed one by one. The server may provide different driving recommendation information for different on-board terminals.

Figure 7:
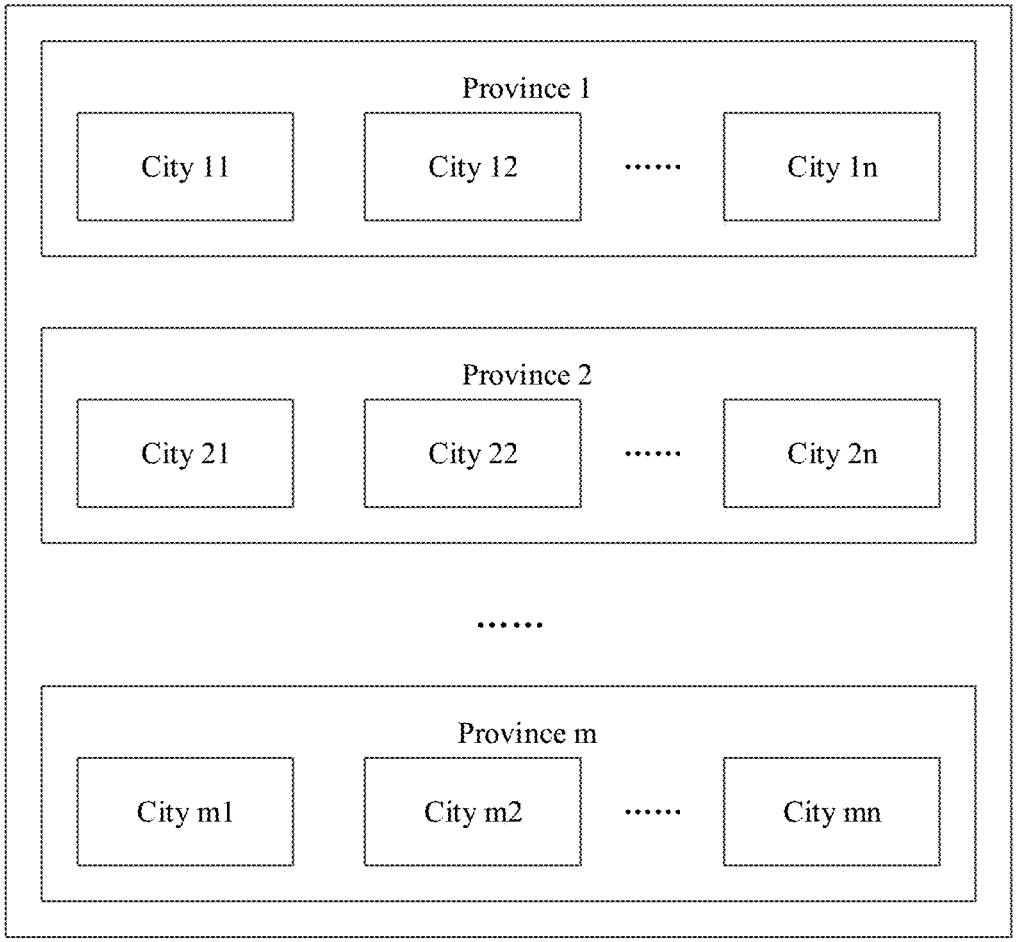
FIG. 7 is a schematic diagram of a storage structure of vehicle data provided by the embodiments of the present disclosure.

In one implementation, after receiving the vehicle data transmitted by the on-board terminal, the server may divide the positioning information of the vehicle data into regions, and then store the vehicle data in units of regions. FIG. 7 is a schematic diagram of a storage structure of vehicle data provided by the embodiments of the present disclosure. Referring to FIG. 7, vehicle data of different provinces (Province 1, Province 2 . . . Province m, where m is a positive integer) are stored separately, and vehicle data of different cities in a same province (City 11, City 12 . . . City 1n, where n is a positive integer) are stored separately, etc., which is no longer listed one by one. Division accuracy may be improved under the premise of taking into account a communication rate, for example, the division accuracy may be improved to 100 m.

For example, a background algorithm-processing platform may acquire the vehicle data from the server and subdivide it step by step, from province, city, district until street, and store the vehicle data step by step. In this way, early warning ranges that intersect with each other may be determined based on vehicle data in the same street, which reduces the amount of calculation compared with determining early warning ranges that intersect with each other based all acquired vehicle data. In addition, step-by-step storage simplifies data structure, reduces a load of database, and facilitates fast recall of data.

In some related solutions: on-board sensors collect the vehicle's speed data; on-board cameras collect images of the vehicle's surroundings; an on-board processor identifies an obstacle around the vehicle by using these images, calculates a distance between the obstacle and the vehicle, and determines whether a collision will occur according to the speed data and the distance, and if so, an early warning is performed.

In this scheme, an early warning scheme will be implemented only after the on-board cameras clearly capture the obstacle. In this way, a time for the driver to take measures is very short, and the driver needs to respond quickly enough to avoid a collision accident. It can be seen that early warning timeliness of this scheme is poor.

However, in the embodiments shown in the present disclosure, the server performs an overall early warning based on data transmitted by respective on-board terminals, which provides a more timely early warning from a global perspective compared with an early warning scheme of a single on-board terminal.

A specific implementation of the methods for early warning of vehicle collision will be described below with reference to FIGS. 8 to 10.

Figure 8:
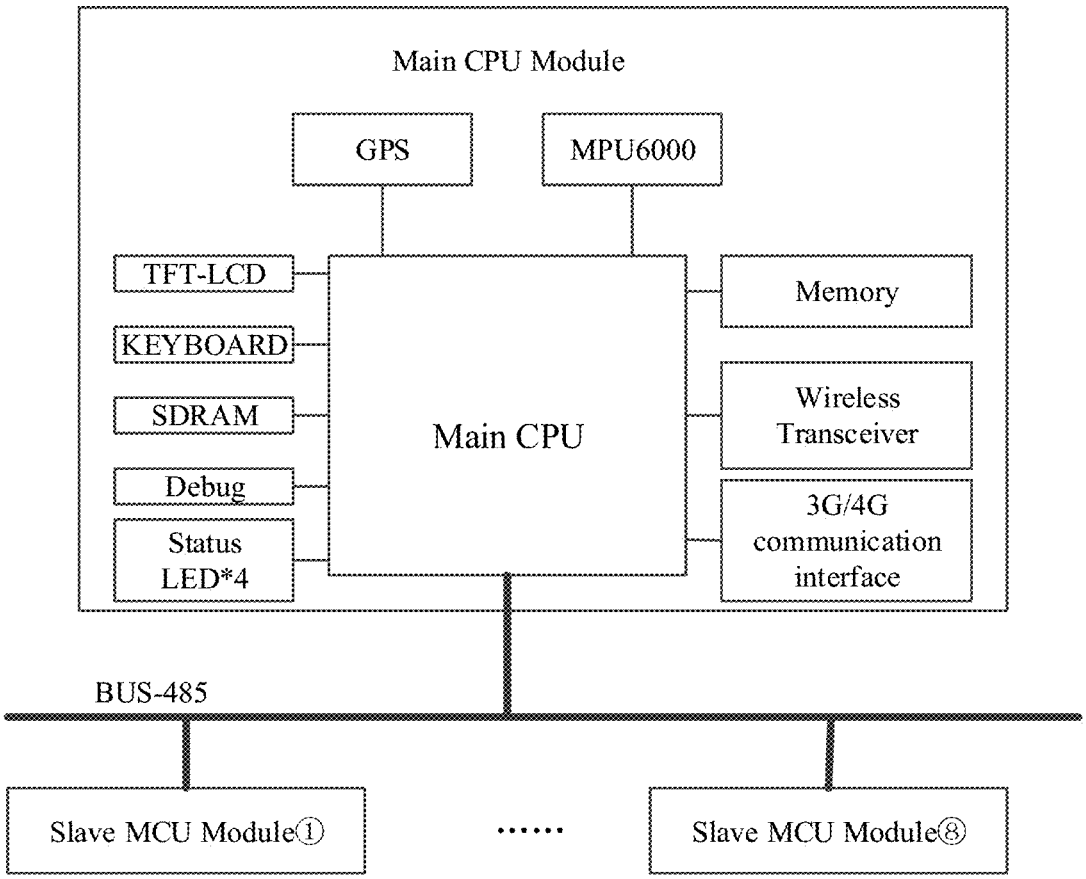
FIG. 8 is a schematic structural diagram of an on-board terminal provided by the embodiments of the present disclosure.

FIG. 8 is a schematic structural diagram of an on-board terminal provided by the embodiments of the present disclosure. As shown in FIG. 8, the on-board terminal may comprise: a main processor module (Main CPU Module) and an 8-way slave Microcomputer (MCU) modules, and the eight slave MCU modules are hung on a 485 communication bus (BUS-485). The main processor module may include: a Main CPU (main processor) for user data processing; a GPS for collecting positioning information of vehicles; MPU6000 for collecting acceleration data and direction data of vehicles; a TFT-LCD (Thin Film Transistor-Liquid Crystal Display) for displaying early warning information or other information such as user interaction interface; 4 status LEDs for early warning or indicating working status of other components; a Wireless Transceiver for data transmission with other on-board terminals; a 3G/4G communication interface for data transmission with a server. The main processor module may further include some common components, such as: a KEYBOARD for users to input information; an SDRAM (Synchronous Dynamic Random-Access Memory); Debug, a debugging program; a Memory, which will not be introduced one by one.

Figure 9:
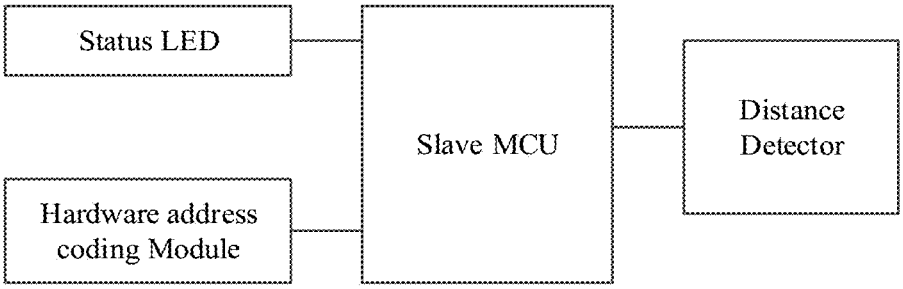
FIG. 9 is a schematic structural diagram of a slave microcomputer module provided by the embodiments of the present disclosure.

FIG. 9 is a schematic structural diagram of a slave single-chip microcomputer module provided by the embodiments of the present disclosure. As shown in FIG. 9, the slave single-chip microcontroller module includes a Slave MCU, a Distance Detector, a status LED, and a hardware address coding module. The Slave MCU is connected to the Distance Detector, the Status LED, and the Hardware address coding Module, respectively. The Distance Detector may be an ultrasonic ranging unit, that is, a sensor in the foregoing embodiment, and may collect position data and distance data of an obstacle as distance-sensing data. The Hardware address coding Module may perform hardware coding according to the position where it is placed, and a 3-bit hardware encoder may be selected, so as to encode the 8-way slave single-chip microcontroller module.

The on-board terminal in FIG. 8 may be divided into the following units: an obstacle monitoring unit, a data acquisition unit, a communication unit, a near-field alarm unit, and other auxiliary module units.

The obstacle monitoring unit may include the above-mentioned eight slave MCU modules. A layout of the eight slave MCU modules may refer to FIG. 2. Whether there is an obstacle in 8 directions is monitored by using the Distance Detector of the eight slave MCU modules, and if so, a distance between the obstacle and the vehicle is detected as a distance-sensing data. This distance-sensing data is transmitted to the Main CPU Module through an interrupted trigger manner of the 485 bus.

The data acquisition unit may include the above-mentioned GPS and MPU6000. The data acquisition unit obtains the vehicle's positioning information, speed information, and orientation information through the GPS and the MPU6000, and transmits the information to the server through the communication unit.

The communication unit includes the above-mentioned 3G/4G unit, or in some cases, may also include a 2G unit.

The near-field alarm unit may include a Bluetooth module or a near-field wireless transceiver (that is, the above-mentioned wireless transceiver), which may use a PCB (Printed Circuit Board) antenna to reduce costs of equipment. Communication between close vehicles may be performed through the near-field alarm unit.

Other auxiliary module units may include: the above-mentioned KEYBOARD, SDRAM, Debug, Memory, etc.

The on-board terminal may obtain data acquired by the obstacle monitoring unit and the data acquisition unit described above via an interface of On-Board Diagnostics (OBD). The on-board terminal determines whether there is an obstacle within an early warning range of the vehicle itself based on the obtained data; if so, obtains data transmitted by on-board terminals of other vehicles through the communication unit; matches the data of the vehicle itself with the data of the other vehicles, and determines whether the obstacle is a vehicle based on a matching result; if so, outputs a first early warning information through the above-mentioned status LEDs or the display.

Furthermore, the on-board terminal may further transmit data acquired by the data acquisition unit to the server through the communication unit, and the server determines whether there are mutually intersected early warning ranges; if so, transmits early warning information to an on-board terminal corresponding to the mutually intersected early warning ranges.

For example, early warning of vehicle collision may be performed by the on-board terminal itself, or may be performed by a server. In one case, if communication quality between the on-board terminal and the server is good, early warning by the server may be adopted, and if communication quality between the on-board terminal and the server is poor, early warning by the on-board terminal itself may be adopted.

Figure 10:
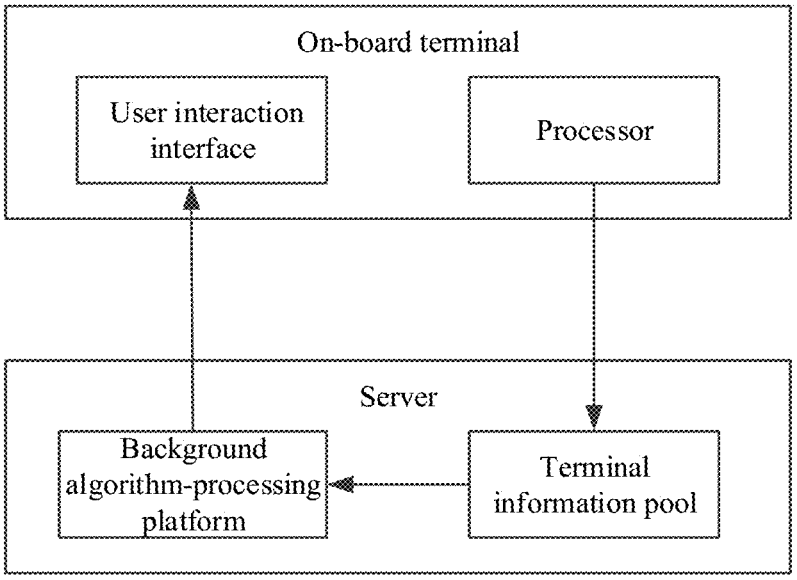
FIG. 10 is a schematic diagram of interactions between an on-board terminal and a server provided by the embodiments of the present disclosure.

FIG. 10 is a schematic diagram of interaction between an on-board terminal and a server provided by the embodiments of the present disclosure. Referring to FIG. 10, the on-board terminal includes a user interaction interface and a processor. The server includes a terminal information pool and a background algorithm-processing platform.

The processor of the on-board terminal acquires vehicle data through the OBD interface, for example, including speed information, positioning information, and orientation information, and transmits these information to the server's terminal information pool through the 3G or 4G network; the background algorithm-processing platform acquires these information from the terminal information pool, divides it into regions step by step, and stores it according to the divided regions.

The background algorithm-processing platform determines whether there are other vehicles in the vehicle's early warning range based on the stored vehicle data, and analyzes and predicts a risk of the vehicle after a period of time in the future, and feeds back early warning information of the risk to a user interaction interface of the on-board terminal. Users (such as the driver) may obtain the early warning information of the risk in real time through the interaction interface.

It can be seen that this scheme adopts the idea of the Internet of Things, coordinates on-board terminals for risk prediction and early warning prompts, and effectively performs early warning of vehicle collision. In addition, the terminal information pool does not include information about stationary vehicles or other obstacles. For the background algorithm-processing platform, only vehicle information is early warned, which reduces a false-positive rate of early warning.

The above scheme may be divided into three modes: terminal-to-server, server-to-terminal, and terminal-to-terminal. The terminal-to-server may be understood as: an on-board terminal transmits vehicle data to a server, such as positioning information of vehicles, driving speed of vehicles, and orientation information of vehicles, and the server performs early warning based on these vehicle data. The server-to-terminal may be understood as: the server performs trajectory prediction and risk assessment based on these vehicle data, and may further generate driving recommendations for the vehicle. The terminal-to-terminal may be understood as: corresponding to the embodiment in FIG. 1, early warning is performed through communication between on-board terminals.

Figure 11:
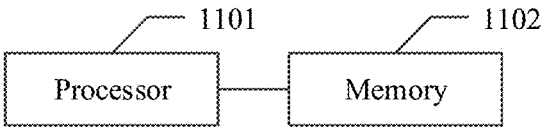
FIG. 11 is a schematic block diagram of an on-board terminal provided by the embodiments of the present disclosure.

The embodiments of the present disclosure further provide an on-board terminal. FIG. 11 is a schematic block diagram of the on-board terminal provided by the embodiments of the present disclosure. As shown in FIG. 11, the on-board terminal comprises a processor 1101 and a memory 1102. The memory 1102 stores thereon a computer program executable on the processor 1101, and when executing the computer program, the processor 1101 implementing the foregoing method for early warning of vehicle collision applied to an on-board terminal.

Figure 12:
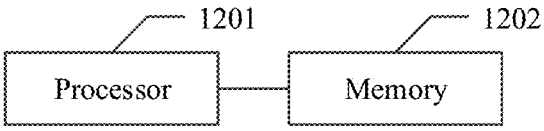
FIG. 12 is a schematic block diagram of a server provided by the embodiments of the present disclosure.

The embodiments of the present disclosure further provide a server. FIG. 12 is a schematic block diagram of the server provided by the embodiments of the present disclosure. As shown in FIG. 12, the server comprises a processor 1201 and a memory 1202. The memory 1202 stores thereon a computer program executable on the processor 1201, and when executing the computer program, the processor 1201 implementing the foregoing method for early warning of vehicle collision applied to a server.

The embodiments of the present disclosure further provide an on-board terminal, comprising: a first processor, a plurality of second processors, and a wireless transceiver, where each second processor is connected to a sensor, and the wireless transceiver is configured to communicate with other on-board terminals. Each second processor is configured to transmit first distance-sensing data detected by a sensor connected to itself to the first processor. The first processor is configured to determine whether there is an obstacle within an early warning range of the on-board terminal based on the received first distance-sensing data; and acquire, through the wireless transceiver, distance-sensing data transmitted by other on-board terminals as second distance-sensing data when it is determined that there is an obstacle; determine whether the obstacle is a vehicle based on a matching result of the first distance-sensing data and the second distance-sensing data; output a first early warning information when it is determined that the obstacle is a vehicle.

For example, the first processor may be the Main CPU shown in FIG. 8, and the second processor may be the Slave MCU shown in FIG. 8.

Figure 13:
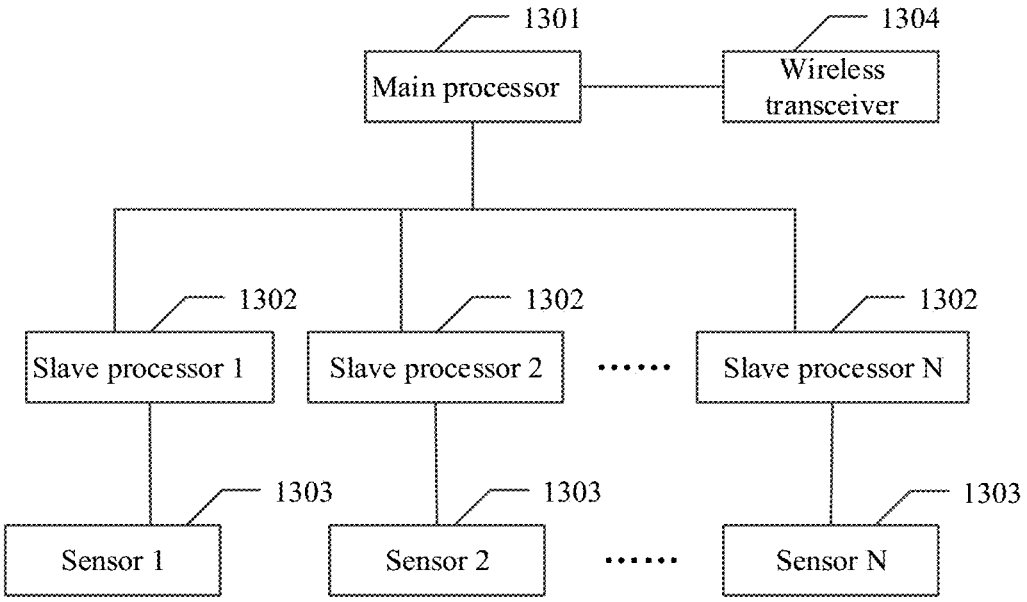
FIG. 13 is another schematic structural diagram of an on-board terminal provided by the embodiments of the present disclosure.

FIG. 13 is another schematic structural diagram of an on-board terminal provided by the embodiments of the present disclosure, in which the first processor is represented by a main processor and the second processor is represented by a slave processor. As shown in FIG. 13, the on-board terminal comprises: a main processor 1301, a plurality of slave processors (slave processor 1, slave processor 2, . . . slave processors N, where N is a positive integer, and the number of slave processors is not limited) 1302 and a wireless transceiver 1304, where each slave processor 1302 is connected to a sensor 1303, and the wireless transceiver 1304 is used to communicate with other on-board terminals. Each slave processor 1302 is configured to transmit first distance-sensing data detected by a sensor 1303 connected to itself to the main processor 1301. The main processor 1301 is configured to determine whether there is an obstacle within an early warning range of the on-board terminal based on the received first distance-sensing data; and acquire, through the wireless transceiver 1304, distance-sensing data transmitted by other on-board terminals as second distance-sensing data when it is determined that there is an obstacle; match the first distance-sensing data with the second distance-sensing data, and determine whether the obstacle is a vehicle based on a matching result; output a first early warning information when it is determined that the obstacle is a vehicle.

As an implementation, the on-board terminal further comprises: a positioner and a speed detector (not shown in FIG. 13); the positioner is configured to acquire orientation information of a vehicle to which it belongs, and transmit the orientation information to the main processor; and the speed detector is configured to collect speed information of the vehicle to which it belongs, and transmit the speed information to the main processor.

The main processor 1301 is further configured to determine an early warning range of the vehicle to which it belongs according to the speed information and the orientation information; or to determine the early warning range of the vehicle to which it belongs according to the speed information, the orientation information, and vehicle type information of the vehicle to which it belongs.

The main processor 1301 in this embodiment corresponds to the main processor in FIG. 8, the slave processor 1302 in this embodiment corresponds to the slave microcontroller in FIG. 8, the sensor 1303 in this embodiment corresponds to the distance sensor in FIG. 9, the positioner in this embodiment corresponds to the GPS in FIG. 8, and the speed detector in this embodiment corresponds to the MPU6000 in FIG. 8.

The on-board terminal may further comprise: a bus, a TFT-LCD, Status LEDs, a communication interface, a KEYBOARD, a SDRAM, Debug, a Memory, a Distance Detector, Status LEDs, a Hardware address coding Module, and so on. Embodiments of the on-board terminal may refer to the method embodiments described above, which will not be repeatedly described herein.

The embodiments of the present disclosure further provide a non-transitory computer-readable storage medium that stores computer instructions, which are used to cause a computer to execute any one of the above methods for early warning of vehicle collision.

Those of ordinary skill in the art should understand that the discussion of any of the above embodiments is merely exemplary, and is not intended to imply that the scope of the present disclosure (including the claims) is limited to these examples; under the thinking of the present disclosure, the above embodiments or technical features in different embodiments may also be combined, the steps may be implemented in any order, and there are many other variations of different aspects of the present disclosure as described above, which are not provided in the details for sake of brevity.

In addition, to simplify the description and discussion, and so as not to make the present disclosure difficult to understand, well-known power/ground connections to integrated circuit (IC) chips and other components may or may not be shown in the provided accompanying drawings. In addition, apparatuses may be shown in the form of a block diagram in order to avoid making the present disclosure difficult to understand, and this further takes into account the fact that details regarding implementations of these apparatuses in block diagrams are highly dependent on a platform on which the present disclosure will be implemented (i.e. these details should be completely within the understanding of those skilled in the art). Although specific details (e.g., circuits) are set forth to describe exemplary embodiments of the present disclosure, it will be apparent to those skilled in the art that the present disclosure may be implemented without these specific details or with changes in these specific details. Therefore, these descriptions should be considered as illustrative and not limitative.

Although the present disclosure has been described in connection with specific embodiments of the present disclosure, many replacements, modifications, and variations of these embodiments will be apparent to those skilled in the art from the foregoing description. For example, other memory architectures (e.g., dynamic RAMs (DRAMs)) may use the discussed embodiments.

The embodiments of the present disclosure are intended to cover all such replacements, modifications, and variations that fall within the broad scope of the appended claims. Therefore, any omissions, modifications, equivalent replacements, improvements, etc. made within the spirit and principles of the present disclosure should be included in the scope of the present disclosure.

This application claims the benefit of priority right of Chinese patent application with the application No. of 201910816239.9, filed on Aug. 30, 2019 in China. For all purposes, the entire disclosure of the aforementioned application is incorporated herein by reference as part of this application.

What is claimed is:

1. A method for early warning of vehicle collision applied to a first on-board terminal, the first on-board terminal being configured in a first vehicle, a plurality of first sensors being respectively disposed at a plurality of preset positions of the first vehicle, the method comprising:

acquiring distance-sensing data detected by the first sensors as first distance-sensing data;

determining whether there is an obstacle within an early warning range of the first vehicle based on the first distance-sensing data;

acquiring distance-sensing data transmitted by on-board terminals of other vehicles within a communication range of the first vehicle as second distance-sensing data when it is determined that there is the obstacle in the early warning range of the first vehicle;

determining whether the obstacle is a vehicle based on a matching result of the first distance-sensing data and the second distance-sensing data; and outputting a first early warning information when it is determined that the obstacle is the vehicle, wherein the acquiring the distance-sensing data detected by the first sensors as the first distance-sensing data comprises:

receiving a first sensing message transmitted by each first sensor of the plurality of first sensors, wherein the first sensing message includes an identifier of the first sensor and its corresponding first distance-sensing data, the acquiring the distance-sensing data transmitted by on-board terminals of other vehicles within the communication range of the first vehicle as the second distance-sensing data comprises:

establishing a wireless connection with a second on-board terminal, wherein the second on-board terminal is configured in a second vehicle, the second vehicle is a vehicle within the communication range of the first vehicle, and a plurality of second sensors are respectively disposed at a plurality of preset positions of the second vehicle; and receiving a second sensing message transmitted by the second on-board terminal, wherein the second sensing message includes an identifier of each second sensor of the plurality of second sensors and corresponding second distance-sensing data detected by the second sensor, the determining whether the obstacle is the vehicle comprises:

determining whether there are matched first distance-sensing data and second distance-sensing data; and if so, determining that the obstacle is the vehicle, the method further comprising:

determining, for first distance-sensing data and second distance-sensing data that are successfully matched, location information of the second vehicle according to an identifier of a first sensor corresponding to the matched first distance-sensing data and an identifier of a second sensor corresponding to the matched second distance-sensing data, wherein the outputting the first early warning information comprises:

outputting the first early warning information which includes the location information.

2. The method according to claim 1, further comprising:

acquiring speed information and orientation information of the first vehicle; and determining the early warning range of the first vehicle according to the speed information and the orientation information; or determining the early warning range of the first vehicle according to the speed information, the orientation information, and vehicle type information of the first vehicle, wherein the determining whether there is the obstacle within the early warning range of the first vehicle based on the first distance-sensing data comprises:

determining a distance between the obstacle and the first vehicle based on the first distance-sensing data; and determining whether the obstacle is within the early warning range based on the distance between the obstacle and the first vehicle.

3. The method according to claim 2, wherein the outputting the first early warning information comprises:

determining an early warning level according to the distance between the obstacle and the first vehicle; and outputting the first early warning information which includes the early warning level; or determining a safe speed of the first vehicle according to the distance between the obstacle and the first vehicle and a reaction time; and outputting the first early warning information which includes the safe speed.

4. The method according to claim 2, further comprising:

acquiring positioning information of the first vehicle; and transmitting the positioning information and the early warning range of the first vehicle to a server, so that the server determines whether there are mutually intersected early warning ranges based on received positioning information and early warning ranges transmitted by on-board terminals, and if so, transmits a second early warning information to an on-board terminal within the mutually intersected early warning ranges.

5. The method according to claim 1, wherein the establishing the wireless connection with the second on-board terminal comprises:

establishing the wireless connection with the second on-board terminal configured in the second vehicle through wireless transceivers configured in the first vehicle and the second vehicle; or establishing a Bluetooth connection with the second on-board terminal.

6. The method according to claim 1, wherein the establishing the wireless connection with the second on-board terminal comprises:

searching, by means of broadcasting, for an on-board terminal of an other vehicle within the communication range of the first on-board terminal as the second on-board terminal;

if an on-board terminal is found as the second on-board terminal, establishing the wireless connection with the second on-board terminal; and if an on-board terminal is not found, stopping the broadcasting, and after receiving a connection request of the second on-board terminal, establishing the wireless connection with the second on-board terminal.

7. An on-board terminal comprising a memory, a processor, and a computer program stored on the memory and executable on the processor, the processor implementing the method of claim 1 when the processor executes the computer program.

8. A method for early earning of vehicle collision, the method comprising a method applied to a server and a method applied to a first on-board terminal, the first on-board terminal being configured in a first vehicle, a plurality of first sensors being respectively disposed at a plurality of preset positions of the first vehicle, the method applied to the server comprising:

acquiring vehicle data transmitted by a plurality of on-board terminals, the vehicle data including positioning information of vehicles, driving speeds of vehicles, and orientation information of vehicles;

determining an early warning range of a vehicle to which each of the plurality of on-board terminals belongs based on the vehicle data;

determining whether there are mutually intersected early warning ranges in early warning ranges of the plurality of on-board terminals; and transmitting a third early warning information to an on-board terminal within the mutually intersected early warning ranges when there are mutually intersected early warning ranges, the method applied to the first on-board terminal comprising:

acquiring distance-sensing data detected by the first sensors configured as first distance-sensing data;

determining whether there is an obstacle within an early warning range of the first vehicle based on the first distance-sensing data;

acquiring distance-sensing data transmitted by on-board terminals of other vehicles within a communication range of the first vehicle as second distance-sensing data when it is determined that there is the obstacle in the early warning range of the first vehicle;

determining whether the obstacle is a vehicle, based on a matching result of the first distance-sensing data and the second distance-sensing data; and outputting a first early warning information when it is determined that the obstacle is the vehicle, wherein the acquiring the distance-sensing data detected by the first sensors as the first distance-sensing data comprises:

receiving a first sensing message transmitted by each first sensor of the plurality of first sensors, wherein the first sensing message includes an identifier of the first sensor and its corresponding first distance-sensing data, the acquiring the distance-sensing data transmitted by on-board terminals of other vehicles within the communication range of the first vehicle as the second distance-sensing data comprises:

establishing a wireless connection with a second on-board terminal, wherein the second on-board terminal is configured in a second vehicle, the second vehicle is a vehicle within the communication range of the first vehicle, and a plurality of second sensors are respectively disposed at a plurality of preset positions of the second vehicle; and receiving a second sensing message transmitted by the second on-board terminal, wherein the second sensing message includes an identifier of each second sensor of the plurality of second sensors and corresponding second distance-sensing data detected by the second sensor, the determining whether the obstacle is the vehicle comprises:

determining whether there are matched first distance-sensing data and second distance-sensing data; and if so, determining that the obstacle is a vehicle, the method applied to the first on-board terminal further comprising:

determining, for first distance-sensing data and second distance-sensing data that are successfully matched, location information of the second vehicle according to an identifier of a first sensor corresponding to the matched first distance-sensing data and an identifier of a second sensor corresponding to the matched second distance-sensing data, wherein the outputting the first early warning information comprises:

outputting the first early warning information which includes the location information.

9. The method according to claim 8, further comprising:

predicting, for the on-board terminal within the mutually intersected early warning ranges, a movement trajectory of a vehicle to which the on-board terminal belongs based on vehicle data transmitted by the on-board terminal, the movement trajectory including time information and position information of a plurality of trajectory points; and determining trajectory points with both same time information and same position information as matched trajectory points by matching the movement trajectory.

10. The method according to claim 9, wherein the transmitting the third early warning information to the on-board terminal within the mutually intersected early warning ranges comprises:

transmitting the third early warning information to the on-board terminal corresponding to the matched trajectory points, wherein the third early warning information includes time information and position information of the matched trajectory points.

11. A server comprising a memory, a processor, and a computer program stored on the memory and executable on the processor, the processor implementing the method applied to the server of claim 8 when the processor executes the computer program.

12. An on-board terminal comprising: a first processor, a plurality of second processors, and a wireless transceiver, wherein each second processor is connected to a sensor, the on-board terminal being configured in a first vehicle, a plurality of first sensors being respectively disposed at a plurality of preset positions of the first vehicle, and wherein the wireless transceiver is configured to communicate with other on-board terminals;

each second processor is configured to transmit first distance-sensing data detected by each first sensor of the plurality of first sensors connected to each second processor and an identifier of the first sensor to the first processor as a first sensing message;

the first processor is configured to determine whether there is an obstacle within an early warning range of the on-board terminal based on received first distance-sensing data; acquire, through the wireless transceiver, a second sensing message transmitted by a second on-board terminal configured in a second vehicle when it is determined that there is the obstacle, the second vehicle being a vehicle within communication range of the first vehicle, the second sensing message including an identifier of each second sensor of a plurality of second sensors respectively disposed at a plurality of preset positions of the second vehicle and corresponding second distance-sensing data detected by the second sensor; determine whether the obstacle is a vehicle based on a matching result of the first distance-sensing data and the second distance-sensing data, determine, for first distance-sensing data and second distance-sensing data that are successfully matched, location information of the second vehicle according to an identifier of a first sensor corresponding to the matched first distance-sensing data and an identifier of a second sensor corresponding to the matched second distance-sensing data; and output a first early warning information including the location information when it is determined that the obstacle is the vehicle.

13. The on-board terminal according to claim 12, further comprising a positioner and a speed detector;

the positioner being configured to obtain orientation information of the first vehicle, and transmit the orientation information to the first processor;

the speed detector being configured to collect speed information of the first vehicle, and transmit the speed information to the first processor;

the first processor being further configured to determine an early warning range of the first vehicle according to the speed information and the orientation information; or determine the early warning range of the first vehicle according to the speed information, the orientation information, and vehicle type information of the first vehicle.

* * * * *